US008360611B2

(12) United States Patent
Luo et al.

(10) Patent No.: US 8,360,611 B2
(45) Date of Patent: Jan. 29, 2013

(54) LIGHTING DEVICE

(75) Inventors: Ting Luo, Shenzhen (CN); Xian-Wei Ma, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 783 days.

(21) Appl. No.: 12/563,978

(22) Filed: Sep. 21, 2009

(65) Prior Publication Data

US 2010/0327781 A1 Dec. 30, 2010

(30) Foreign Application Priority Data

Jun. 30, 2009 (CN) ..... 2009 1 0303885

(51) Int. Cl.
*F21S 4/00* (2006.01)

(52) U.S. Cl. ..... 362/249.16; 362/362; 362/394

(58) Field of Classification Search ..... 362/249.01, 362/249.02, 249.12, 249.16, 362, 371, 382, 362/394; 315/320

See application file for complete search history.

(56) References Cited

U.S. PATENT DOCUMENTS

| | | | | |
|---|---|---|---|---|
| 7,311,421 | B1 * | 12/2007 | Fahl | 362/249.16 |
| 2005/0024882 | A1 * | 2/2005 | Sherman | 362/419 |
| 2005/0047130 | A1 * | 3/2005 | Waters | 362/231 |
| 2008/0089065 | A1 * | 4/2008 | Li | 362/252 |

* cited by examiner

*Primary Examiner* — Tung X Le
(74) *Attorney, Agent, or Firm* — Altis Law Group, Inc.

(57) ABSTRACT

A lighting device comprising: a shell, a plurality of luminophors, a first slideway and a second slideway. The plurality of luminophors is set in an external surface of the shell. The first slideway and the second slideway each of which comprise an up peristome and a down peristome respectively. A plurality of trigger switches is set in the first slideway. Each of which is configured for connecting/disconnecting a first circuit, so as to turn on/off the one or more luminophors. A ball is located movable along the slideways. A launching device is set in a bottom of the second slideway and is configured for driving the ball to move. A controlling unit is configured for connecting/disconnecting a second circuit, so as to connect/disconnect a power supply, which supplies power for the lighting device via the first circuit.

10 Claims, 5 Drawing Sheets

LIGHTING DEVICE

BACKGROUND

1. Technical Field

The present disclosure relates to a lighting device.

2. Description of Related Art

In general, a lighting device may include a plurality of luminophors. Users can use a switch to turn on/off all the luminophors directly. However, it results that the all luminophors simultaneously being lit/turned off lacks attractive features interesting to viewers or users.

Therefore, what is need is a lighting device added with some interesting features.

DETAILED DESCRIPTION

Figure 1:
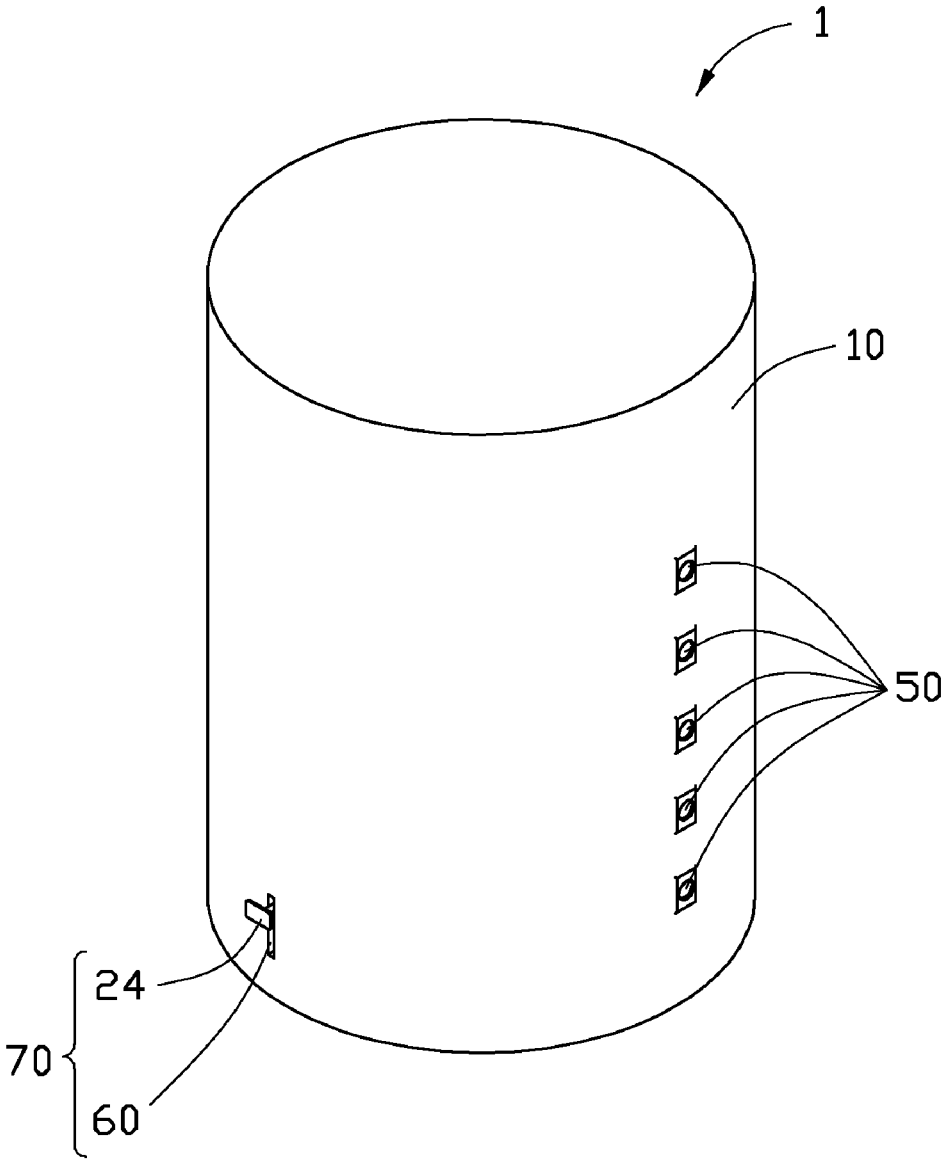
FIG. 1 is an isometric view of a lighting device in accordance with an exemplary embodiment.
Figure 2:
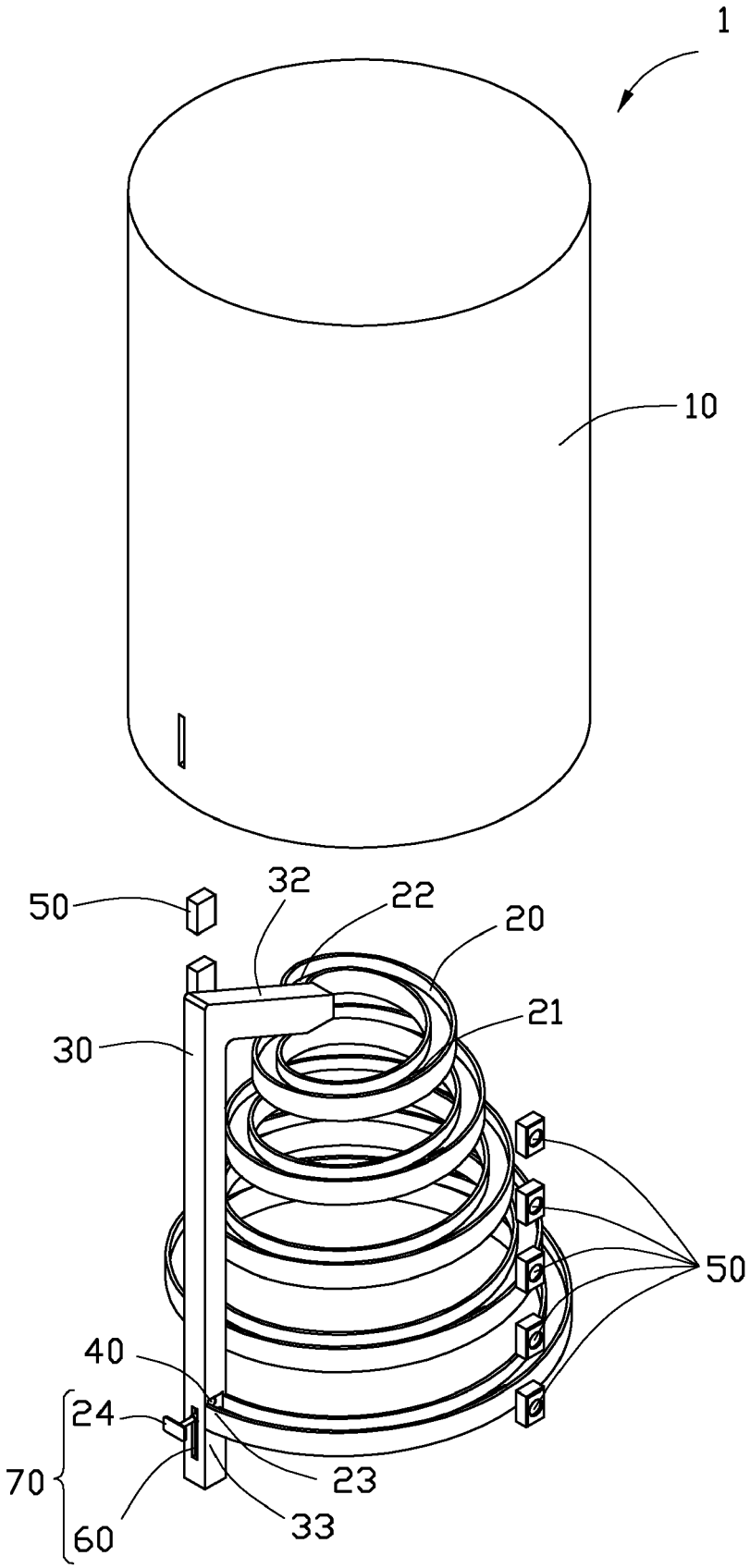
FIG. 2 is a partially exploded view of the lighting device of FIG. 1.
Figure 3:
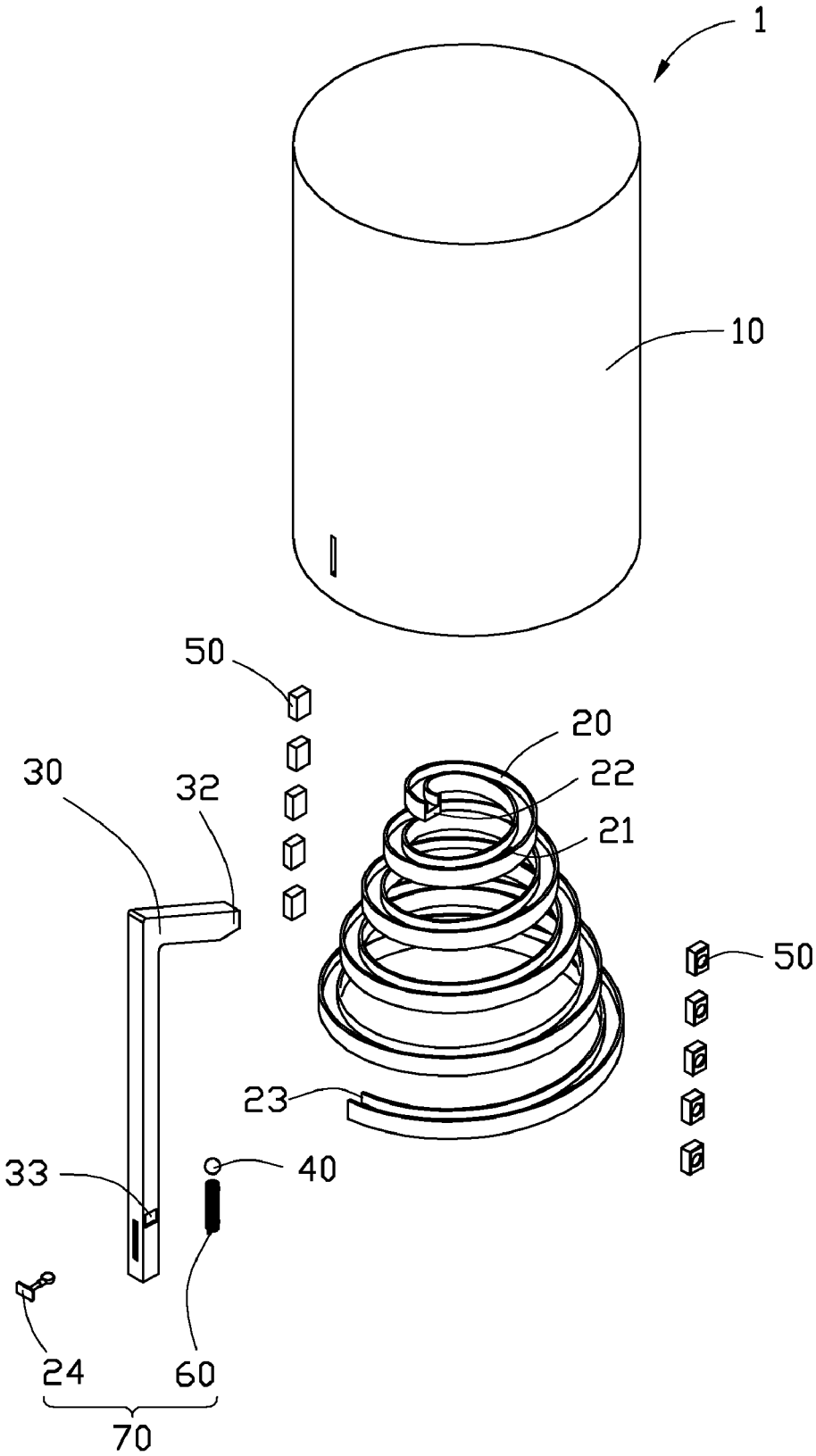
FIG. 3 is an exploded view of the lighting device of FIG. 1.
Figure 4:
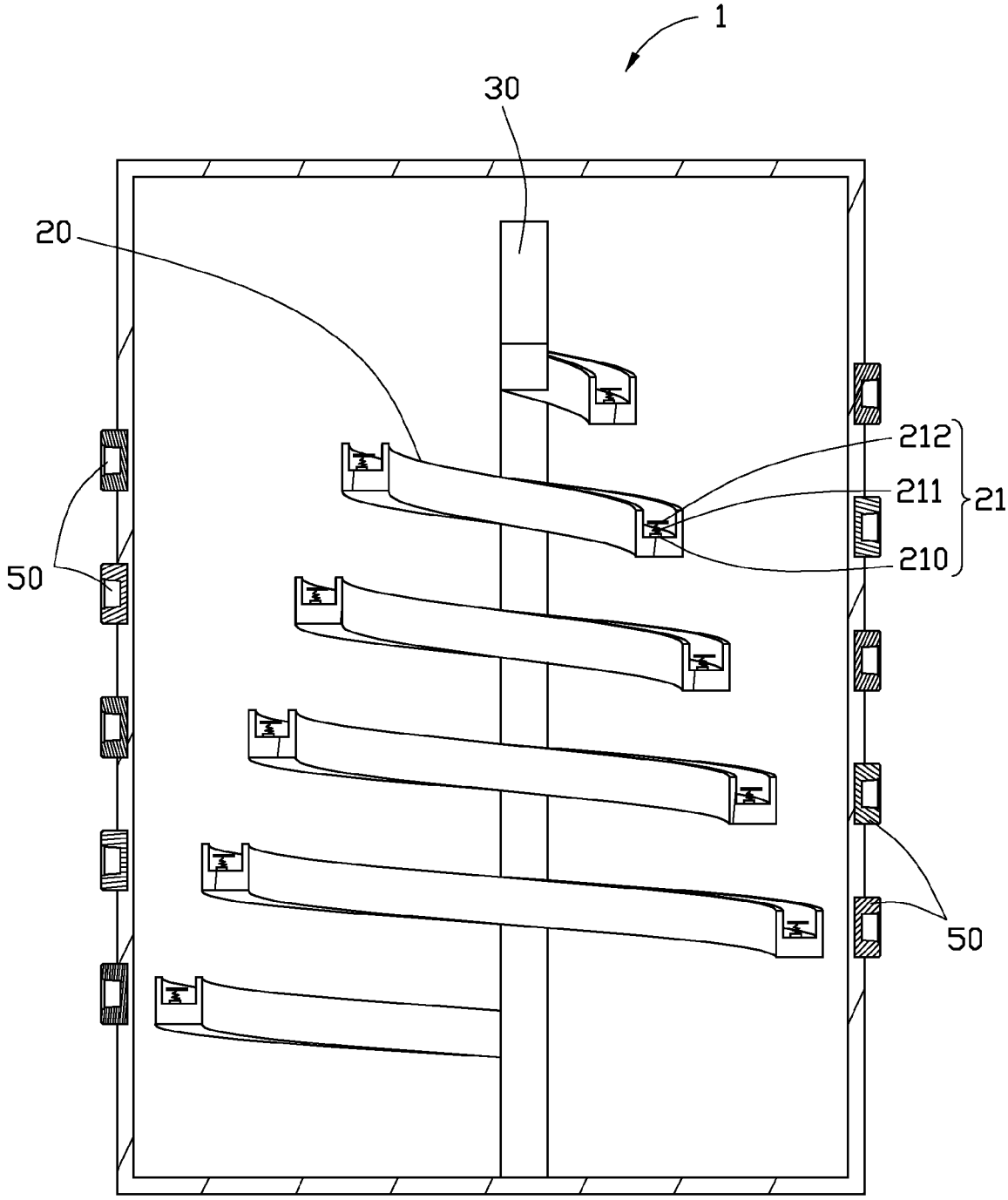
FIG. 4 is a sectional view of the lighting device of FIG. 1.
Figure 5:
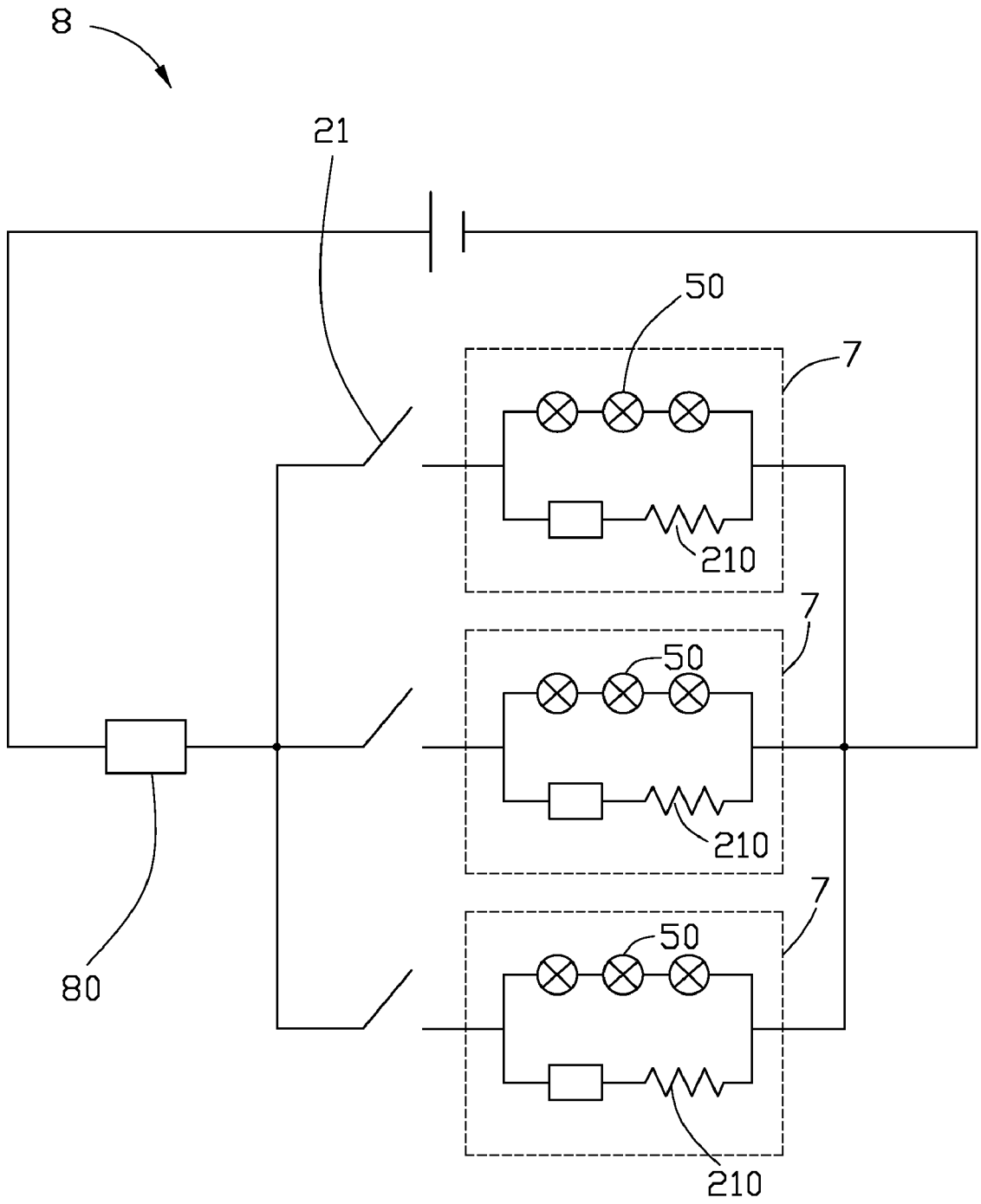
FIG. 5 is a circuit diagram of the lighting device of FIG. 1.

Referring to FIGS. 1-5, a lighting device 1 is disclosed. The lighting device 1 includes a hollow shell 10, a first slideway 20, a second slideway 30, a launching device 70, a controlling unit 80, a ball 40, and a plurality of luminophors 50. The luminophors 50 are set in an external surface of the shell 10.

In the exemplary embodiment, the first slideway 20 includes a plurality of trigger switches 21. Each of the trigger switches 21 is configured for connecting/disconnecting a first circuit 7, so as to turn on/off one or more luminophors 50. The controlling unit 80 is configured for connecting/disconnecting a second circuit 8, so as to connect/disconnect a power supply, which supplies power for the lighting device 1 via the second circuit 8. In the exemplary embodiment, the controlling unit 80 may be a switch. User can press the switch 80 to connect/disconnect the second circuit 8. In another embodiment, the controlling unit 80 may be a timer, and the second circuit 8 is disconnected when the time elapsed reaches a predetermined time. The launching device 70 is set in the bottom of the second slideway 30, and is configured for driving the ball 40 to move.

When the second circuit 8 is connected by the controlling unit 80, the launching device 70 drives the ball 40 to move from the second slideway 30 to the first slideway 20, and then the ball 40 moves along the first slideway 20 to an original position, where the ball 40 is originally placed, due to the gravity. During the movement of the ball 40 along the first slideway 20, the ball 40 presses each of the trigger switches 21 in turn. The pressed trigger switch 21 connects the first circuit 7, thus, one or more luminophors 50 connected to the first circuit 7 are turned on. For better understanding the disclosure, the following is a detailed exemplary embodiment.

The first slideway 20 is spiral shaped, and includes an up peristome 22 and a down peristome 23.

The second slideway 30 is a pipe, and includes an up peristome 32 and a down peristome 33. The up peristome 32 is connected to the up peristome 22 of the first slideway 20, and the down peristome 33 is connected to the down peristome 23 of the first slideway 20.

Each of the trigger switches 21, positioned at a predetermined position of the first slideway 20, includes an induction coil 210 fixed in the first slideway 20, a spring 211, and a sheet metal 212. One end of the spring 211 is connected to the induction coil 210, and another end of the spring 211 is connected to the sheet metal 212. The sheet metal 212 is located on the induction coil 210 via the spring 211.

The launching device 70 includes a controlling switch 24 and an elastic element 60. The elastic element 60 is connected to the bottom of the second slideway 30. The controlling switch 24 is connected to the elastic element 60, and a portion of the controlling switch 24 is exposed out of the second slideway 30 via a sliding groove (not labeled) of the second slideway 30. The ball 40 is located on the controlling switch 24. In the exemplary embodiment, the ball 40 is a metal ball.

When the second circuit 8 is connected by the controlling unit 80, and the controlling switch 24 is pressed along the sliding groove, the controlling switch 24 drives the elastic element 60 to move along the sliding groove, and the elastic element 60 is deformed. In the exemplary embodiment, the elastic element 60 is a spring. When releasing the press operation on the controlling switch 24, the elastic element 60 resumes, and drives the ball 40 to flip and move from the down peristome 33 of the second slideway 30 to the up peristome 32 of the second slideway 30, leading the ball 40 to the up peristome 22. Then the ball 40 moves from the up peristome 22 of the first slideway 20 to the down peristome 23 of the first slideway 20 due to the gravity. During the movement of the ball 40, the ball 40 presses the sheet metal 212 of each one of the trigger switches 21, and the pressed sheet metal 212 presses the spring 211 to touch the induction coil 210, and thus, the trigger switch 21 is pressed. The pressed trigger switch 21 connects the first circuit 7, and one or more luminophors 50 are turned on.

Simultaneously, when the first circuit 7 is connected, the induction coil 210 generates a magnetic field. The magnetic field adsorbs the sheet metal 212 to continuously touch the induction coil 210, and thus, the first circuit 7 keeps a connection state, and the one or more luminophors 50 keep in a turned-on state.

When the controlling unit 80 disconnects the second circuit 8, so that, all the first circuit 7 are disconnected. The magnetic field disappears, thus, the spring 211 resumes, and drives the sheet metal 212 to leave the induction coil 210. One or more luminophors 50 connected to the trigger switch 21 are turned off.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A lighting device comprising:

a shell;

a plurality of luminophors set in an external surface of the shell;

a first slideway and a second slideway each of which comprise an up peristome and a down peristome; wherein the up peristome of the first slideway is connected to the up peristome of the second slideway, and the down peristome of the first slideway is connected to the down peristome of the second slideway;

a plurality of trigger switches set in the first slideway, each of which is configured for connecting/disconnecting a first circuit which connects one or more of the plurality of luminophors, so as to turn on/off the one or more luminophors;

a ball located movable along the slideways;

a launching device set in a bottom of the second slideway and configured for driving the ball to move; and a controlling unit configured for connecting/disconnecting a second circuit, so as to connect/disconnect a power supply, which supplies power for the lighting device via the first circuit;

wherein, when the controlling unit connects the second circuit and the launching device drives the ball to move from the down peristome of the second slideway to the up peristome of the first slideway, the ball moves along the first slideway to the down peristome of the first slideway due to the gravity, and presses each of the trigger switches in turn, and the pressed trigger switch connects the first circuit, such that, the corresponding one or more luminophors are turned on.

2. The lighting device as described in claim 1, wherein each trigger switch comprises an induction coil fixed in the first slideway, a spring, and a sheet metal; one end of the spring is connected to the induction coil, and another end of the spring is connected to the sheet metal; the sheet metal is located on the induction coil via the spring; during the movement of the ball along the first slideway, the ball presses the sheet metal, the pressed sheet metal presses the spring to touch the induction coil, such that, the trigger switch is pressed.

3. The lighting device as described in claim 2, wherein when the trigger switch is pressed, the first circuit is connected, the induction coil generates a magnetic field, which absorbs the sheet metal to continuously touch the induction coil, and thus, the first circuit keeps in a connection state, and the one or more luminophors keep in a turned-on state.

4. The lighting device as described in claim 2, wherein when the controlling unit disconnects the second circuit, the first circuit is disconnected, the magnetic field disappears, and the spring resumes, and drives the sheet metal to leave the induction coil, so that, one or more luminophors are turned off.

5. The lighting device as described in claim 1, wherein the launching device comprises a controlling switch and an elastic element, the elastic element is connected to the bottom of the second slideway, the controlling switch is connected to the elastic element, and a portion of the controlling switch is exposed out of the second slideway via a sliding groove, and the ball is located on the controlling switch;

when the controlling switch is pressed along the sliding groove, the controlling switch drives the elastic element to move along the sliding groove, and the elastic element is deformed; and when the press operation on the controlling switch is released, the elastic element resumes, and drives the ball to flip and move from the down peristome of the second slideway to the up peristome of the second slideway.

6. The lighting device as described in claim 5, wherein the elastic element is a spring.

7. The lighting device as described in claim 1, wherein the first slideway is spiral shaped.

8. The lighting device as described in claim 1, wherein the second slideway is a pipe.

9. The lighting device as described in claim 1, wherein the controlling unit is a timer, and the second circuit is disconnected, when the time elapsed reaches a predetermined time.

10. The lighting device as described in claim 1, wherein the controlling unit is a switch.

* * * * *